United States Patent [19]

Citrin

[11] 4,187,724

[45] Feb. 12, 1980

[54] REPLACEABLE TIP FOR A PIPETTE

[75] Inventor: Paul S. Citrin, Danbury, Conn.

[73] Assignee: Indicon Inc., Brookfield Center, Conn.

[21] Appl. No.: 948,486

[22] Filed: Oct. 4, 1978

Related U.S. Application Data

[63] Continuation of Ser. No. 868,686, Jan. 11, 1978, abandoned.

[51] Int. Cl.[2] ..... B01L 3/02

[52] U.S. Cl. ..... 73/425.4 P

[58] Field of Search ..... 73/425.4 P, 425.6; 422/100

[56] References Cited

U.S. PATENT DOCUMENTS

| | | | |
|---|---|---|---|
| 3,732,734 | 5/1973 | Avakiar | 73/425.6 |
| 3,766,784 | 10/1973 | Walker | 73/425.4 P |
| 3,766,785 | 10/1973 | Smernoff | 73/425.6 |
| 3,853,012 | 12/1974 | Scordato | 73/425.6 |
| 3,918,308 | 11/1975 | Reed | 73/425.6 |

*Primary Examiner*—S. Clement Swisher

*Attorney, Agent, or Firm*—St. Onge, Steward, Johnston, Reens & Noe

[57] ABSTRACT

A replaceable pipette tip is described which forms a tight sealing engagement with the working end of a pipette. In one embodiment for a pipette tip a cam surface is provided to enable a slight tip rotation when the working end of a pipette is inserted in the tip. A particularly effective and reliable seal is obtained when a pipette tip having integrally molded ring seals and a cam surface is employed with a pipette working end having a resilient insert located to form an effective seal with the molded rings.

8 Claims, 8 Drawing Figures

Fig. 1.
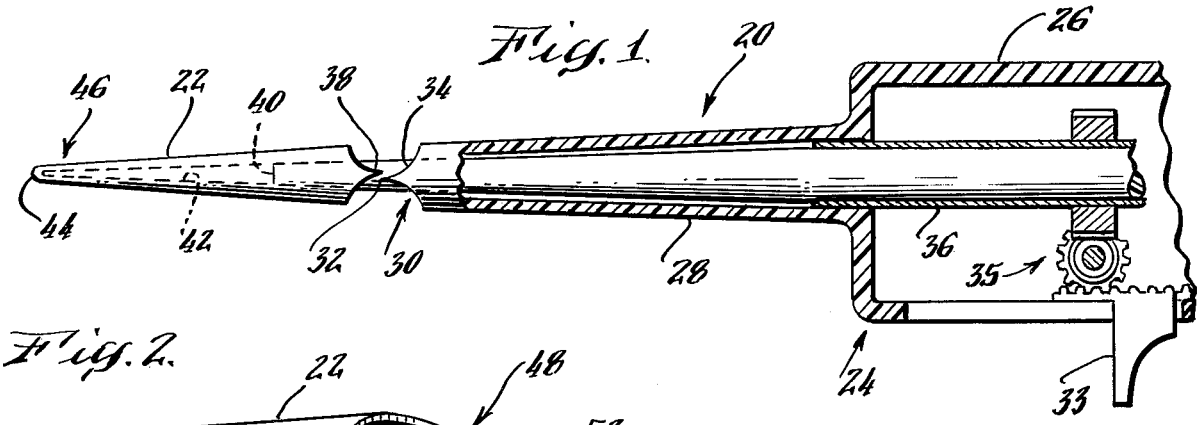
Fig. 2.
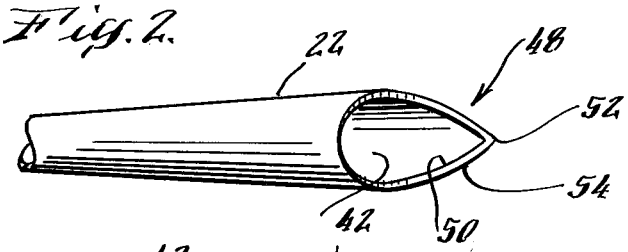
Fig. 4.
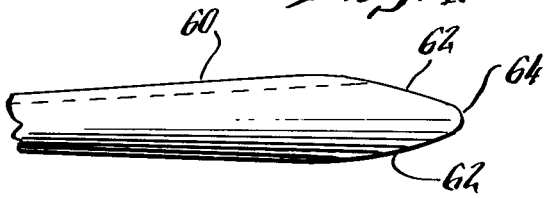
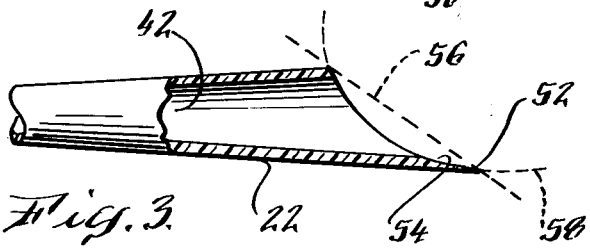
Fig. 3.
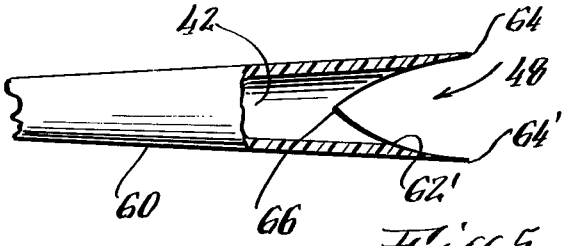
Fig. 5.
Fig. 6.
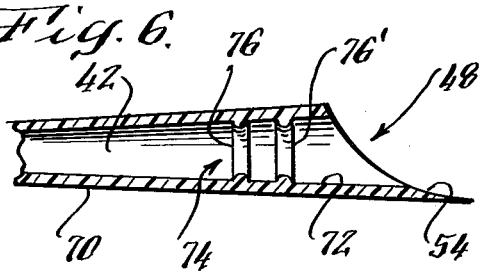
Fig. 7.
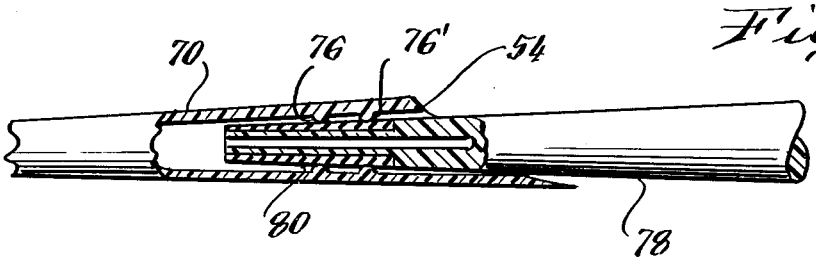
Fig. 8.
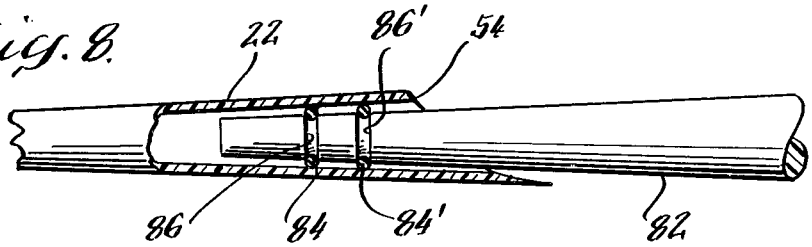

REPLACEABLE TIP FOR A PIPETTE

This is a continuation, of application Ser. No. 868,686 filed on Jan. 11, 1978, now abandoned.

FIELD OF THE INVENTION

This invention relates to a replaceable tip for use with a pipette employed to take up and discharge liquid.

BACKGROUND OF THE INVENTION

Pipettes for handling precise quantities of liquid are well known in the art. A typical manual pipette is described in U.S. Pat. No. 3,766,784 to Walker. It is common, as illustrated in FIG. 1 of the Walker patent, to employ a replaceable tip to be used in conjunction with such pipette and afterwards to be disposed of. Typically, such replaceable tip has a main conically shaped body with a through bore starting at a large pipette receiving opening and terminating at a liquid flow port for contact with the liquid to be handled. The use of a replaceable tip advantageously avoids wetting of pipette surfaces by contaminating liquids or the inadvertent contamination of samples by the pipette itself.

As illustrated with reference to the aforementioned Walker patent, a pipette is shown wherein a piston is moved in a cylinder under manual action by an operator. The advance of the piston along the cylinder causes the displacement of volume and correspondingly results in the take-up or discharge of liquid samples depending upon the direction of movement of the piston. It can be understood from an inspection of FIG. 1 of the Walker patent that the accuracy of a pipette also depends upon the precision by which the piston is moved in the take-up stroke and that leakage between the replaceable tip and the working end of the pipette should be avoided. In some instances pipette tips have been used wherein integrally molded O rings are used to provide an enhanced seal with a pipette.

In practice, when replaceable tips are mass produced they may not always provide a precise tight fit with the pipette end. As a result, leakage occurs and accuracy of the entire pipette may suffer. Such variation in accuracy is particularly objectionable when very small quantities of liquid are to be handled.

In a co-pending patent application entitled "Manually Holdable Automatic Pipette" filed on the same day and by the same inventor as for this invention and assigned to the same assignee, a manually holdable, automatically operated pipette is described. This pipette employs an actuating mechanism and control circuit to provide a highly accurate pipette.

As described with reference to this co-pending application, the pipette's accuracy is significantly enhanced by employing a replaceable tip capable of providing a consistently high quality seal with the pipette.

SUMMARY OF THE INVENTION

With a replaceable tip in accordance with the invention, a high quality seal can be consistently obtained in an automatic manner. As described with reference to a preferred form for a replaceable tip in accordance with the invention, the pipette receiving end of the tip is provided with a cam surface which is so inclined that it causes a tip rotation when the tip is introduced on a pipette. Rotational motion of the replaceable tip is brought about with a wedging element located on the pipette and arranged to contact the tip's cam surface as the tip is applied to a pipette.

With a replaceable tip in accordance with the invention, the working end of a pipette is inserted into the bore of a tip. As the pipette working end enters the tip, the cam surface on the latter engates a wedging element on the pipette. With further advancement between the replaceable tip and the pipette, an automatic twisting movement occurs producing a tight fit between the pipette and tip with enhancing sealing.

As described with reference to another form of replaceable pipette tip in accordance with the invention, a seal element is integrally molded to project into the through bore of the pipette tip at its pipette receiving end. A particularly effective engagement with a pipette's working end is achieved by using a pair of molded rings which protrude into the through bore of the tip and engage a resilient insert affixed to the working end of the pipette. The integrally molded seal element forms an edge protrusion which extends in an annular manner around the bore, though other forms such as helical may be used provided the helix is annularly closed at at least one end.

It is, therefore, an object of the invention to provide a replaceable tip with features for enhanced sealing to a pipette. It is a further object of the invention to provide a replaceable tip for a pipette whereby a high quality seal and tight fit can be consistently achieved upon the application of the tip to a pipette.

The effectiveness of the seal between a replaceable tip and the working end of a pipette may be further improved by providing the pipette working end with a resilient seal element for contact with the tip. In one form for such resilient seal element, the working end of the pipette is provided with a resilient surface which provides a high quality seal with a replaceable tip having one or more edge seal protrusions on an inner bore.

In another form for the resilient seal element, a pair of O rings are employed in grooves formed in the working end of the pipette. The O rings form an effective seal with a smooth bore of a replaceable tip.

It is, therefore, a further object of the invention to provide a replaceable tip for a pipette wherein the tip is particularly adapted to provide a high quality seal with the pipette, is easy to apply and remove without requiring manual contact.

These and other objects and advantages of a replaceable pipette tip in accordance with the invention can be understood with reference to the following description of a preferred and alternate embodiment described in conjunction with the drawings.

BRIEF DESCRIPTION OF DRAWINGS

FIG. 1 is a partial sectional and side view of a replaceable pipette tip in accordance with the invention mounted on the working end of a pipette;

FIG. 2 is a partial enlarged view of a replaceable pipette tip in accordance with the invention;

FIG. 3 is a partial side view in partial section of the replaceable pipette tip illustrated in FIG. 2;

FIG. 4 is a top plan view of another embodiment for a replaceable pipette tip in accordance with the invention;

FIG. 5 is a side view in elevation and partial section of the replaceable pipette tip illustrated in FIG. 4;

FIG. 6 is a side view in section of another form for a replaceable pipette tip in accordance with the invention;

FIG. 7 is a partial side elevational view in partial section of a replaceable pipette tip as shown in FIG. 6 mounted on the working end of a pipette; and FIG. 8 is a side view in elevation in partial section of a replaceable pipette tip as illustrated in FIG. 2 mounted on the working end of a pipette.

DETAILED DESCRIPTION OF EMBODIMENT

With reference to FIG. 1, an assembly 20 of a replaceable pipette tip 22 in accordance with the invention onto a pipette 24 is illustrated. The pipette 24 is formed of a main housing 26 having a hollow lower segment 28 which terminates with a wedging element 30 having an apex 32 and a wedging surface 34. Within the lower segment 28 is a cylinder barrel 36 which is mounted for rotation relative to the housing 26 for tip release under action of a release lever 33 and linear-to-rotation converting mechanism 35. Mechanism 35 is further described in the aforementioned co-pending patent application.

The cylinder barrel 36 protrudes from the end segment of the housing with a working end 38 which terminates with a liquid flow control port 40. The intake and discharge of liquids in and from the replaceable tip 22 are controlled through port 40. A piston (not shown) is operatively mounted in the cylinder barrel 36 to displace volume and effect the intake and discharge of a liquid sample.

The replaceable tip 22 may have a variety of shapes. In the emboidment of FIGS. 1-3, tip 22 has a generally conical shaped body with a through bore 42 which commences with a liquid flow port 44 at a working end 46 and terminates at a pipette receiving end 48 with a mounting port 50. The tip 22 preferably is formed of a plastic molded body produced with an injection molding process.

The pipette receiving end 48 is selectively shaped so that upon insertion of working end 38 of a pipette 20, a tight fit is automatically achieved. The pipette receiving end 48 of the tip 22 has an apex 52 from which the edge 54 of port 50 recedes. The apex 52 may form a sharp point as illustrated in FIGS. 1-3 or may be blunted as illustrated for the tip in FIGS. 4 and 5. The curve followed by edge 54 can lie along a flat plane 56, but is preferably curved as illustrated in FIG. 3 to lie along a curved surface 58 to follow a helical path. The curvature of surface 58 is a segment of a circle in the projection of FIG. 3 wherein the curvature of the circle of surface 58 is selected to facilitate tightening of the tip 22 to a pipette 20.

Although tip 22 can form a tight fit with a pipette's working end, the tip 22 is preferably employed in conjunction with a pipette having a wedging element such as 30 to impart a slight rotation to the tip when the pipette working end 38 is inserted in the tip. In such case edge 54 functions as a cam surface which enables the wedging element 30 on pipette 20 to cause a slight rotation of the tip. The receding cam surface 54 extends from apex 52 along a generally spiral path determined by surface 58 and the cone angle of tip 22. The pitch of the spiral edge 54 is so selected that the desired rotational twisting screw-like movement of the replaceable tip is enhanced.

With the replaceable tip 60 illustrated in FIGS. 2 and 3, a pair of symmetrically arranged cam surfaces 62-62' are provided with a pair of apices 64-64'. The apices 64-64' are of general blunt shape from which the cam surfaces 62-62'recede along a spiral path to meet at corners such as 66. Use of a pair of opposing cam surfaces 62-62' on the replaceable tip 60 assures symmetrical and properly aligned seating of tip 60 onto a pipette.

With a pipette tip 70 as illustrated in FIG. 6, the internal wall 72 of the through bore 42 of the tip 70 is provided at its pipette receiving end 48 with an integrally molded seal 74. Seal 74 protrudes into bore 42 sufficiently to form an edge-like seal with the working end 38 of the pipette 20.

Seal 74 may have a variety of forms such as a spiral protrusion with the spiral so oriented as to screw onto the working end 38 of a pipette when the cam surface 54 engages the wedging element 30 on pipette 20. In such case care should be exercised to assure that mounting of tip 22 onto pipette 20 will result in a tightening rotation relative to the spiral shaped seal 74.

Preferably, however, seal 74 is formed of a pair of inetgrally molded annular protrusions 76, 76'. The protrusions 76 form molded O rings, each of which sealingly engages a pipette working end such as 38 in FIG. 1 or 78 in FIG. 7.

The molded O rings 76, 76' provide edge seals with a working end of a pipette. Such edge seal is particularly effective when applied to a resilient material 80 located on the working end 78 of a pipette as shown in FIG. 7. The resilient material 80 may be formed of an elastomer material which can be bonded to working end 78. The pair of molded O ring seals 76, 76' assure symmetrical seating of a replaceable tip on a pipette.

FIG. 8 illustrates another form for a high quality sealing engagement between a replaceable pipette tip such as 22 and a working end 82 of a pipette. The working end 82 is provided with a pair of resilient O rings 84-84' seated in grooves 86, 86' formed in the pipette working end 82. The use of O ring seals 84, 84' assures aligned seating of tip 22 and provides a high quality seal for enhanced accuracy in the operation of a pipette.

Having thus described several embodiments for a replaceable pipette tip in accordance with the invention, its advantages can be appreciated. A tight engagement between a replaceable tip and a pipette can be obtained for improvement in the accuracy of the pipette. The tight engagement can be achieved by automatically inducing a screw-like tightening or with the incorporation of sealing elements molded into the body of the replaceable tip. Variations of the described embodiments may be made without departing from the scope and spirit of the invention as defined by the following claims.

What is claimed is:

1. A replaceable tip for use on the working end of a pipette used to take up and discharge liquid comprising a longitudinal hollow tip body having a liquid flow port through which liquid is to be moved for intake and discharge, said hollow tip body having a pipette receiving end sized to fit over the working end of a pipette, said hollow tip body terminating at said pipette receiving end with a cam surface which is inclined relative to the longitudinal hollow tip body, said cam surface being further inclined to produce a rotational twist of the tip when the working end of a pipette is inserted into the pipette receiving end of the tip.

2. The replaceable tip as claimed in claim 1 wherein said cam surface is formed of a pair of generally oppositely spaced cam surfaces.

3. The replaceable tip as claimed in claim 1 wherein the hollow tip body has a through bore and is provided with a plurality of internally facing sealing elements protruding into the through bore at said pipette receiving end for enhanced sealing engagement with a pipette.

4. A replaceable tip for use on the working end of a pipette used to take up and discharge liquid comprising a longitudinal hollow tip body having a generally conically shaped inner through bore commencing at a liquid flow port through which liquid is to be moved for intake and discharge under control by a pipette, said conically shaped inner through bore terminating at the other end of the tip with an enlarged mounting port sized to advance along a mounting axis over the working end of a pipette, said other tip end being shaped to provide a cam surface having an inclination selected to induce a rotational twist on the replaceable tip when it encounters a wedging surface on a pipette.

5. A replaceable tip for use on the working end of a pipette used to take up and discharge liquid comprising a longitudinal hollow molded main tip body having a liquid flow port through which liquid is to be moved for intake and discharge, said hollow tip body having a through bore extending from said liquid flow port to a pipette receiving end sized to fit over the working end of the pipette, said main tip body being provided at said pipette receiving end with an integrally molded seal element protruding into the through bore to form an edge seal with the working end of a pipette, said pipette receiving end terminating with a cam surface shaped to operatively impart a rotational twist on the pipette tip.

6. The replaceable tip as set forth in claim 5 wherein said seal element is in the form of an integrally molded spiral.

7. The replaceable tip as set forth in claim 5 wherein said seal element is in the form of an annular integrally molded ring.

8. The replaceable tip as set forth in claim 5 wherein said seal element is in the form of a plurality of annular integrally molded rings protruding into said through bore for a distance selected to each sealingly engage the working end of a pipette.

* * * * *